United States Patent [19]

Krasznai et al.

[11] Patent Number: 4,912,805

[45] Date of Patent: Apr. 3, 1990

[54] DUAL-PURPOSE ROTATING BRUSH FOR VACUUM CLEANER

[75] Inventors: Charles Z. Krasznai, Trumbull; Michael E. Bitzel, Monroe; William D. Ryckman, Orange, all of Conn.

[73] Assignee: Black & Decker Inc., Newark, Del.

[21] Appl. No.: 218,568

[22] Filed: Jul. 13, 1988

[51] Int. Cl.[4] ..... A47L 5/30

[52] U.S. Cl. ..... 15/392; 15/159 A; 15/182; 15/366

[58] Field of Search ..... 15/182, 183, 383, 366, 15/391, 392, DIG. 5

[56] References Cited

U.S. PATENT DOCUMENTS

| | | | |
|---|---|---|---|
| 2,459,007 | 1/1949 | Taylor | 15/DIG. 5 |
| 2,668,979 | 2/1954 | MacFarland | 15/392 X |
| 3,737,937 | 6/1973 | Nordeen | 15/366 X |
| 4,361,929 | 12/1982 | Jinkins | 15/392 X |
| 4,662,027 | 5/1987 | Parker et al. | 15/392 |

FOREIGN PATENT DOCUMENTS

| | | | |
|---|---|---|---|
| 1321081 | 6/1973 | United Kingdom | 15/DIG. 5 |

*Primary Examiner*—Chris K. Moore
*Attorney, Agent, or Firm*—Barry E. Deutsch

[57] ABSTRACT

A cylindrical power brush for a vacuum cleaner includes two types of bristle tufts. One type of bristle tuft is short and stiff for contacting and agitating a carpeted surface. The other type of bristle tuft is longer and softer for contacting a hard surface. In addition to the differences in length and bristle stiffness, the tufts for the hard surface contain substantially fewer bristles, whereby catching and rolling of carpet edges is avoided. One embodiment alternates types of bristle tufts in a row of bristle tufts. Another embodiment employs multiple rows of bristle tufts arranged such that a point on a surface being cleaned is contacted alternately by the two types of bristle tuft. Winding up of thread and hair on the axle of the rotating brush is avoided by overlapping annular extensions on a support wheel and a brush spindle. The brush support wheel is locked in place in the floor tool by a resilient locking tab integrally formed with one of the halves of the floor tool.

13 Claims, 8 Drawing Sheets

FIG.4
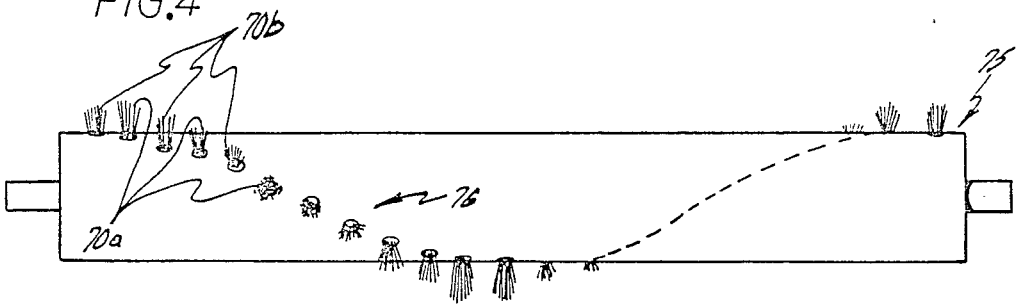
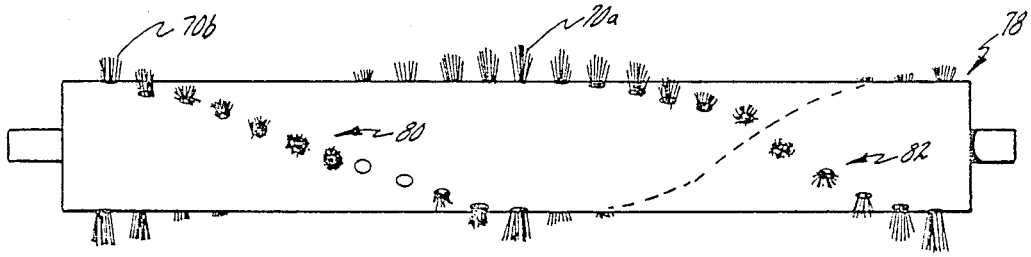
FIG 5

DUAL-PURPOSE ROTATING BRUSH FOR VACUUM CLEANER

BACKGROUND OF THE INVENTION

The present invention relates to housewares and, more particularly, to vacuum cleaners.

Vacuum cleaners are almost indispensable houseware appliances for household cleaning. Generally, they consist of a fan or blower operative to produce a partial vacuum at an intake. Air sucked in by the partial vacuum passes through a filter bag, whereby dirt particles are removed from the air stream. The filtered air is returned to the environment.

Pure-vacuum cleaners, such as described above, are most suited to removing dust, dirt and hair from hard surfaces such as, for example, wood or tile. Dust, dirt and hair found on a carpet or fabric may adhere so strongly thereto that a vacuum-only cleaner may be incapable of satisfactory cleaning. Vacuum cleaners meet this additional problem with a rotating cylindrical brush contacting the surface being cleaned. The brush tends to dislodge dust, dirt and hair which is thereupon entrained in the air stream created by the partial vacuum. Once moving in the air stream, the dust, dirt and hair is filtered from the air stream by the filter bag.

Vacuum cleaners are called upon to clean bare surfaces as well as carpeted surfaces. The bristles of a rotary brush having a length appropriate for contacting the surface of a carpet are too short to contact a hard surface. Conversely, bristles that are long enough to contact a hard surface conventionally bear too hard upon a carpet.

The prior art responds to the problem of differing height requirements for hard and carpeted surfaces by providing means for raising and lowering the floor tool of the vacuum cleaner to a selectable height above the surface. Such a provision adds substantially to the cost of the floor tool.

OBJECTS AND SUMMARY OF THE INVENTION

Accordingly, it is an object of the invention to provide a rotary brush for a vacuum cleaner which overcomes the drawbacks of the prior art.

It is a further object of the invention to provide a rotary brush for a vacuum cleaner including means for loosening soil on bare floors and on carpets.

It is a still further object of the invention to provide a rotary brush for a vacuum cleaner having first and second types of tufts of bristles. The first tufts have a different length and stiffness from the second tufts. The lengths of the first tufts are appropriate for cleaning bare floors, and those of the second tufts are appropriate for cleaning carpets.

It is a still further object of the invention to provide a rotary brush for a vacuum cleaner. The rotary brush has tufts of two different lengths. The tufts of longer length, appropriate for contacting a bare surface, are softer and have fewer strands therein, thereby to avoid catching in the nap of carpets and/or to roll the edges thereof. The shorter length remains substantially out of contact with hard surfaces, but is of appropriate length to contact the nap of carpets.

Briefly stated, the present invention provides a cylindrical power brush for a vacuum cleaner having two types of bristle tufts. One type of bristle tuft is short and stiff for contacting and agitating a carpeted surface. The other type of bristle tuft is longer and softer for contacting a hard surface. In addition to the differences in length and bristle stiffness, the tufts for the hard surface contain substantially fewer bristles, whereby catching and rolling of carpet edges is avoided. One embodiment alternates types of bristle tufts in a row of bristle tufts. Another embodiment employs multiple rows of bristle tufts arranged such that a point on a surface being cleaned is contacted alternately by the two types of bristle tuft. Winding up of thread and hair on the axle of the rotating brush is avoided by overlapping annular extensions on a support wheel and a brush spindle. The brush support wheel is locked in place in the floor tool by a resilient locking tab integrally formed with one of the halves of the floor tool.

According to an embodiment of the invention, there is provided a rotatable brush for a vacuum cleaner comprising: a brush spindle, at least one row of bristle tufts in the brush spindle, the at least one row extending a substantial axial distance along the brush spindle, the at least one row including first and second types of bristle tufts, the first type of bristle tuft having a first length and a first stiffness, the second type of bristle tuft having a second length and a second stiffness, the first length and the first stiffness being effective for agitating a carpet surface, the second length being greater than the first length and being great enough to contact a hard surface, the second stiffness being less than the first stiffness, the first and second stiffnesses being created by at least first and second bundle diameters in the first and second bristle tufts, respectively, the first bundle diameter being substantially greater than the second bundle diameter, and the first and second types of bristle tufts being disposed in a pattern giving substantial coverage of both types of bristle tufts over a point on a surface.

According to a feature of the invention, there is provided a rotatable brush and support wheel for a floor tool of a vacuum cleaner comprising: a brush spindle, at least one support wheel, means for affixing the at least one support wheel non-rotatably in the floor tool, means in the support wheel for rotatably supporting an end of the brush spindle, an annular extension from the brush spindle extending toward the support wheel, an outer ring on the support wheel extending toward the brush spindle, and the outer ring having an axial length effective for providing a substantial overlap of the annular extension, whereby hair and threads are prevented from winding up in the floor tool.

According to a further feature of the invention, there is provided a rotatable brush and support wheel for a floor tool of a vacuum cleaner comprising: a brush spindle, at least one support wheel, means for affixing the at least one support wheel non-rotatably in the floor tool, means in the support wheel for rotatably supporting an end of the brush spindle, an annular extension from the brush spindle extending toward the support wheel, the annular extension forming an inner cavity axially centered in an end of the brush spindle, a guide disk axially centered in the at least one support wheel, the guide disk fitting a substantial distance into the central cavity, whereby hair and threads are prevented from winding up in the floor tool.

According to a still further feature of the invention, there is provided a floor tool for a vacuum cleaner comprising: a rotatable brush, the rotatable brush including a brush spindle, first and second support wheels, cooperating means in the first and second support wheels and the brush spindle for rotatably supporting the brush spindle, the first and second support wheels each including a hub extending axially therefrom in a direction opposite to a direction containing the brush spindle, the floor tool including means for supporting the hub against displacement in a first direction, the floor tool further including a resilient locking tab affixed at a first end to the floor tool, a second end of the locking tap being free, the second end being disposed to contact the hub for locking the hub against motion in a second direction opposite to the first direction, and a resilience of the locking tab permitting the second end to be deflected out of locking contact with the hub, whereby the support wheel and the spindle can be installed in and removed from the floor tool.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 4 is a front view of a cylindrical brush for a vacuum cleaner showing one pattern for installing the two types of bristle tufts.

FIG. 5 is a front view of a cylindrical brush showing a second pattern for installing two types of bristle tufts.

DETAILED DESCRIPTION OF THE PREFERRED EMBODIMENT

The present invention is usable with any type of vacuum cleaner, including externally powered and internally powered types. For purposes of description, however, an internally powered, hand held vacuum cleaner, with a power brush attachment thereon, is employed to provide a concrete environment for the description of the invention.

Figure 1:
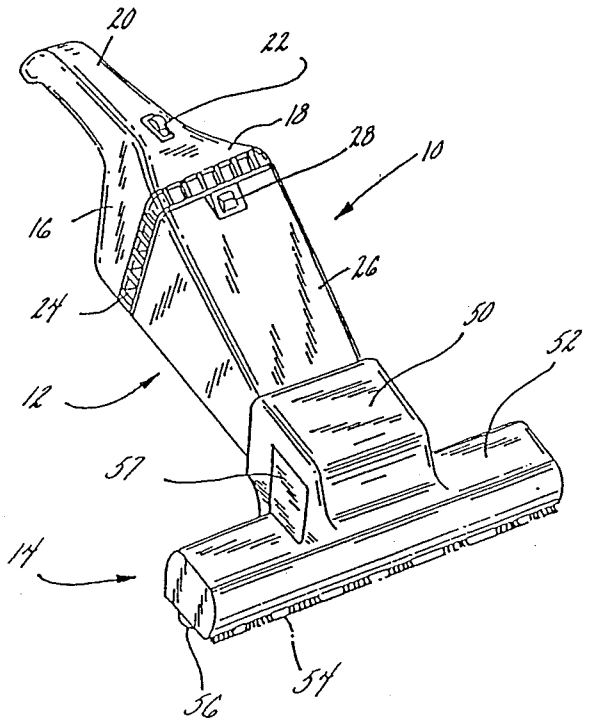
FIG. 1 is a perspective view of a vacuum cleaner system having a floor tool according to an embodiment of the invention.

As shown in FIG. 1, there is shown, generally at 10, a vacuum cleaner assembly within which a rotatable brush according to an embodiment of the invention may be used. Vacuum cleaner assembly 10 includes a vacuum cleaner 12 and a power brush attachment 14 shown fixed together in their cooperating mated conditions to form a single rigid unit. Vacuum cleaner 12 includes a power unit 16 having a body 18 to which a handle 20 is affixed. Handle 20 may contain rechargeable batteries (not shown). A power switch 22 is disposed on body 18 in a position making it accessible to a person holding vacuum cleaner 12 by handle 20. Power switch 22 is conveniently a spring-loaded switch normally biased into the OFF condition and urged to the ON position by pressure of the user's thumb or finger. Actuation of power switch 22 operates an internal motor driving a fan (not shown) within body 18. A set of louvers 24 about the perimeter of body 18 permit exit of air driven by the internal fan.

A dust bowl 26 snaps sealingly onto the forward end of body 18 where it is retained by a spring latch 28. A filter (not shown) inside dust bowl 26 retains dirt within dust bowl 26 while the air is discharged through louvers 24.

A motor cover 50 is integrally formed with a brush housing 52. Motor cover 50 and brush housing 52 may be made of any convenient material, but are preferably made of a molded plastic material such as, for example, polypropylene. A brush opening 54 extends across substantially the entire width of brush housing 52 to reveal a cylindrical brush 56. An access door 57 in motor cover 50 provides access for attaching an internal belt (not shown in FIG. 1) and for cleaning a belt drive mechanism, to be more fully detailed hereinafter.

Figure 2:
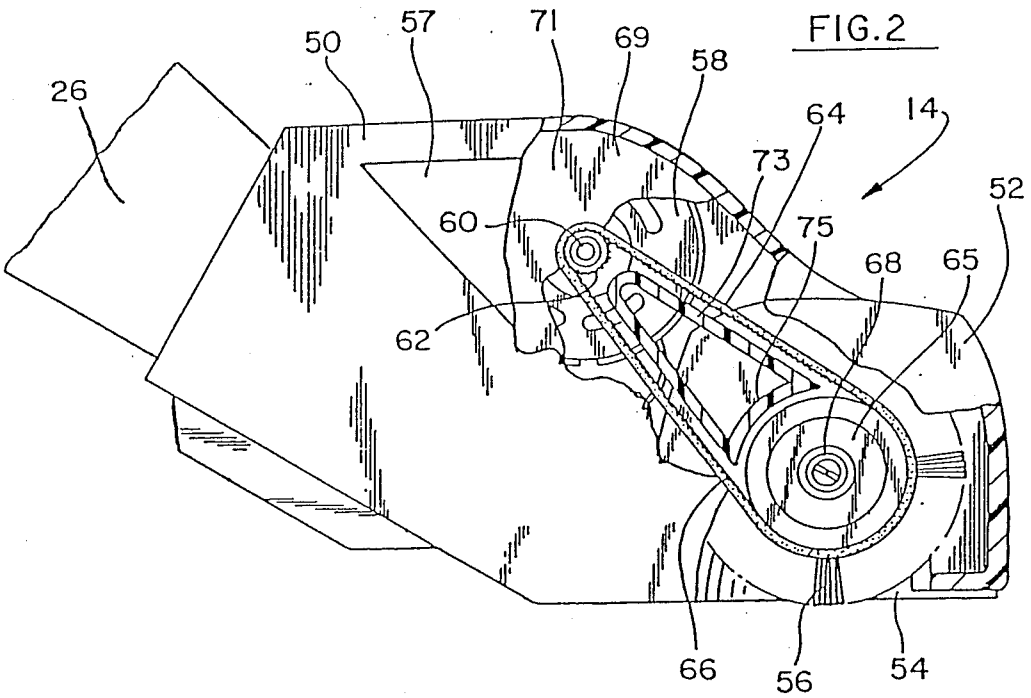
FIG. 2 is a partial cross section of the floor tool of FIG. 1.

As shown in FIG. 2, an electric motor 58 in motor cover 50 includes a motor shaft 60 having a toothed pulley 62 thereon. A flexible toothed drive belt 64 passes over toothed pulley 62 and over a toothed band 66 on cylindrical brush 56. A shaft 68 passing through a brush spindle 65 of cylindrical brush 56 rotatably supports cylindrical brush 56, whereby cylindrical brush 56 may be concertedly driven by electric motor 58. An inner wall 69 between electric motor 58 and flexible toothed drive belt 64 forms a drive belt chamber 71 for isolating dirt and contaminants loosened by power brush attachment 14 from entry into electric motor 58 wherein they may cause damage. A belt guide 73, preferably integrally formed on an inside surface of access door 57, is disposed within the run of flexible toothed drive belt 64 between toothed pulley 62 and toothed band 66. A curved dirt-stripper portion 75 on belt guide 73 is disposed closely adjacent toothed band 66. Curved dirt-stripper portion 75 has a curvature substantially matching the curvature of toothed band 66. The close proximity of curved dirt-stripper portion 75 to toothed band 66 strips larger particles of dirt from toothed band 66 and/or flexible toothed drive belt 64 before they are carried into drive belt chamber 71 wherein they could interfere with free operation of power brush attachment 14. When access door 57 is removed, belt guide 73, removed with it, clears drive belt chamber 71 to enable cleaning of dirt from drive belt chamber 71 or reeving of flexible toothed drive belt 64 onto motor shaft 60.

Rotation of cylindrical brush 56 in the clockwise direction in FIG. 2 tends to agitate a surface being cleaned and to hurl loosened dirt toward and into air inlet opening 30 as is desired.

Figure 3:
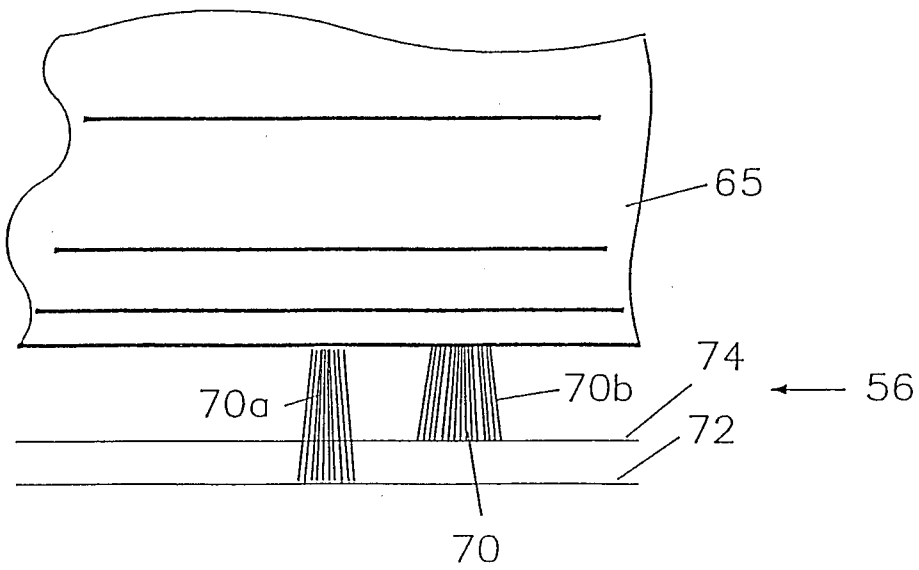
FIG. 3 is a close-up view of a rotatable brush showing two different types of bristle tufts adapted for bare surfaces and carpeted surfaces.

As shown in FIG. 3, brush spindle 65 of cylindrical brush 56 includes a plurality of brush tufts 70. In a conventional rotatable brush, all brush tufts are of substantially the same length and stiffness. The distance between brush spindle 65 and the surface to be cleaned depends on the type of surface being cleaned. A hard surface 72 supports brush spindle 65 at a greater height than does a carpeted surface 74. If the length of brush tufts 70 is such as to give satisfactory contact with hard surface 72, as shown in brush tuft **70*a* to the left of the figure, then it is conventionally so long that it digs into carpeted surface 74, or rolls the edges (not shown) of carpeted surface 74. Conversely, if the length of brush tufts 70 is made short enough to contact carpeted surface 74, as shown in brush tuft 70*b* to the right of the figure, it rotates free of contact on hard surface 72, and thus fails to contribute to cleaning. It is this apparent incompatibility that has forced other manufacturers of vacuum cleaners to the relatively expensive alternative of providing means for raising and lowering brush spindle 65**. The present invention overcomes this problem.

In the present invention, long brush tufts **70*a* are interspersed with short brush tufts 70*b* in one of several patterns to be discussed hereinafter. It has been discovered that far less stiffness is required in brush tufts 70*a* to provide satisfactory cleaning of hard surface 72 than is required to clean carpeted surface 74. Accordingly, brush tufts 70*a*, besides being longer than brush tuft 70*b*, can be less stiff than brush tuft 70*b* without compromising their ability to clean carpeted surface 74. A length and value of stiffness can be found for brush tufts 70*a* which provides satisfactory cleaning of hard surface 72 without digging into or rolling the edges of carpeted surface 74. Thus, both brush tuft 70*a* and brush tuft 70*b* can coexeist in cylindrical brush 56**.

One skilled in the art will recognize, however, that, since brush tufts **70*b* do not contact hard surface 72, they contribute little, if anything, to cleaning. However, when brush tufts 70*a* and brush tufts 70*b* are present in an appropriate pattern, hard surface 72 is satisfactorily cleaned by brush tufts 70*a* alone. In addition, brush tufts 70*a* do contact carpeted surface 74 and, although they do not interfere with carpeted surface 74, they may add additional agitation to that provided by brush tuft 70*b***.

For a given type of material in bristles of brush tufts 70, the stiffness of brush tuft 70 varies with the diameter of the bristles and with the number of bristles making up a brush tuft 70. Another way of specifying the number of bristles in brush tuft 70 is to recite the diameter of a bundle of bristles used to fabricate brush tuft 70.

In one satisfactory embodiment, brush tufts **70*a* employ bristles of about 0.004 inch diameter assembled into bundles of about 0.110 inch diameter, and brush tufts 70*b* are about one millimeter shorter than brush tufts 70*a*** and employ bristles of about 0.006 inch diameter assembled into bundles of about 0.140 inch diameter.

Several patterns of brush tufts **70*a* and 70*b* can be used. The basic rule is to distribute brush tufts 70*a* and 70*b* in a manner which provides for both types of brush tufts to pass over the same portion of a surface being cleaned. In FIG. 4, for example, a cylindrical brush 75 includes a single helical row of brush tufts 76 in which brush tufts 70*a* alternate with brush tufts 70*b***. Although it is recognized that the different types of brush tufts contact a surface side by side, and not in the same track, spreading of the bristles in each brush tuft as it contacts a surface tends to cause sufficient overlap for adequate cleaning.

As shown in FIG. 5, a cylindrical brush 78 includes a first helical row of brush tufts 80 containing only brush tufts **70*b* and a second spiral row of brush tufts 82 containing only brush tufts 70*a*. As cylindrical brush 78 is rotated, the brush tufts in each of helical rows of brush tufts 80 and 82** contact a particular portion of the surface being cleaned in alternating sequence.

A further pattern is similar to that shown in FIG. 5 except that each helical row of brush tufts is divided in the center into one half containing brush tuft **70*a* and the other half containing brush tuft 70*b*. The half of helical row of brush tufts 80, for example, containing brush tuft 70*a* is on the same side of cylindrical brush 78 as the half of spiral row of brush tufts 82 containing brush tuft 70*b*. In this way, a particular portion of a surface being cleaned is contacted in alternating sequence by brush tufts 70*a* and 70*b***.

Other patterns would occur to one skilled in the art without departing from the spirit and scope of the present invention.

For purposes of orienting the reader, the following brief resume is given of a brush-mounting technique fully disclosed in U.S. Pat. 4,841,594, the disclosure of which is herein incorporated by reference.

Figure 6:
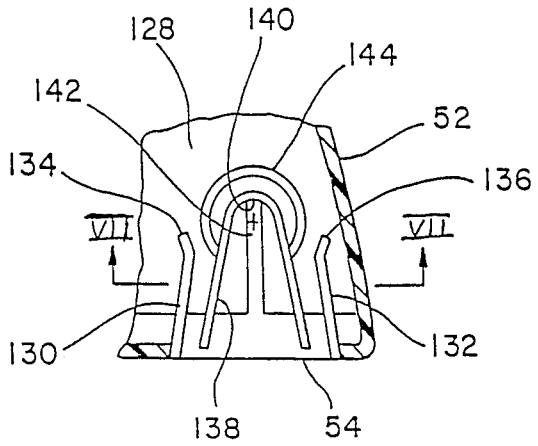
FIG. 6 is a cross section inside a floor tool showing an end wall thereof.
Figure 7:
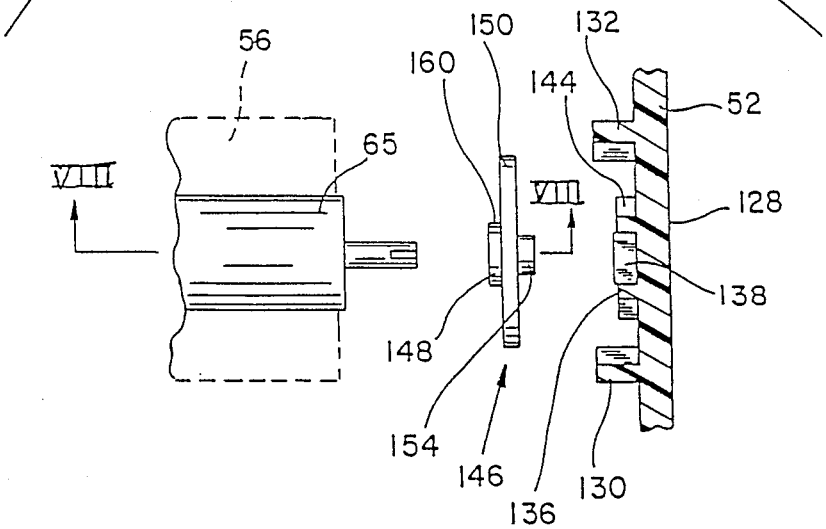
FIG. 7 is an exploded partial cross section taken along VII—VII in FIG. 6.

As shown in FIG. 6, an inside view of brush housing 52 is shown looking toward an end 128 thereof. Cylindrical brush 56, and other elements are removed in this view for clarity of illustration. Reference should also be made to FIG. 7 during the following description. It will be understood that a mirror image of the apparatus illustrated and described is disposed in the other end of motor cover 50 but, since the shape and function of such mirror image will be fully understood from the following description, it will not be described.

First and second retainer arms 130 and 132, integrally molded with end 128, are angled slightly toward each other. An upper end of retainer arm 130 terminates in an outwardly angled portion 134. Similarly, an upper end of retainer arm 132 terminates in an outwardly angled portion 136. A hairpin-shaped hub guide 138, integrally molded with end 128, terminates in a part-circular hub retainer 140. Part-circular hub retainer 140 has a center 142 indicated by a + symbol. A part-circular back-up rib 144, disposed outside part-circular hub retainer 140, has its center co-located with center 142. It will be noted that center 142 is located upward beyond the closest approach of retainer arms 130 and 132. Also, retainer arms 130 and 132 extend further outward from end 128 than do outwardly angled portion 134 and 136.

Figure 8:
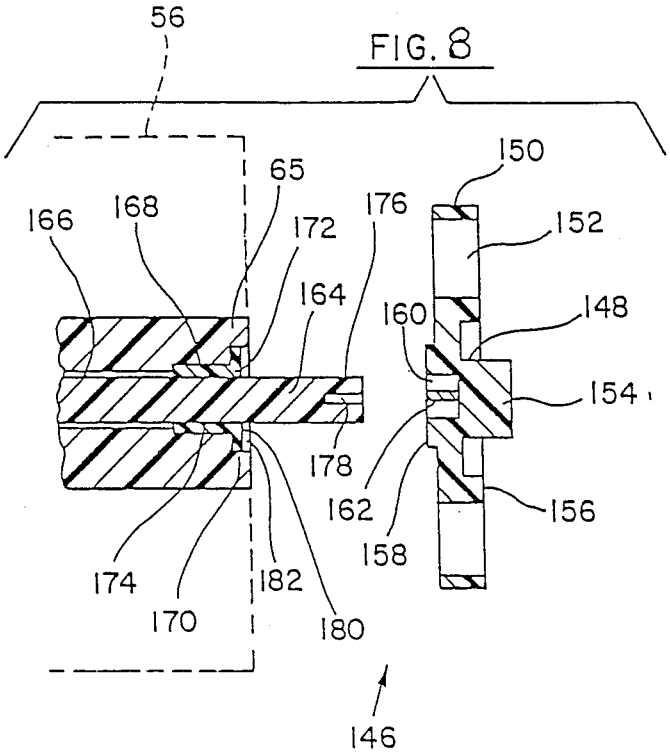
FIG. 8 is a cross section taken along VIII—VIII in FIG. 7.
Figure 9:
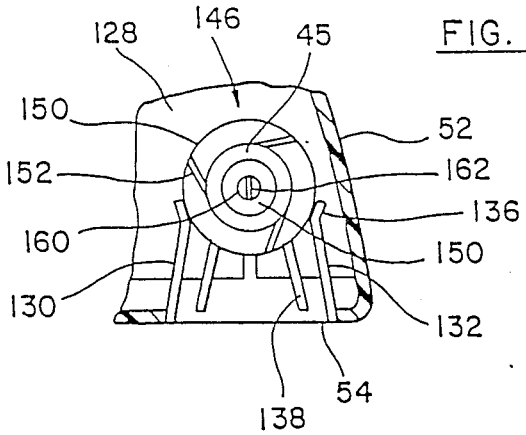
FIG. 9 is a cross section corresponding to FIG. 6 with a flex-rim wheel installed.

As shown in FIGS. 8 and 9, a flex-rim wheel 146 includes a central disk 148 and a thin, flexible rim 150. A plurality of spokes 152 (best seen in FIG. 9) extend diagonally from a perimeter of central disk 148 to retain central disk 148 in a concentric position. Preferably, a small number of spokes 152, preferably three, is combined with a thin cross section in rim 150 in order to provide substantial deformability in rim 150.

Figure 11:
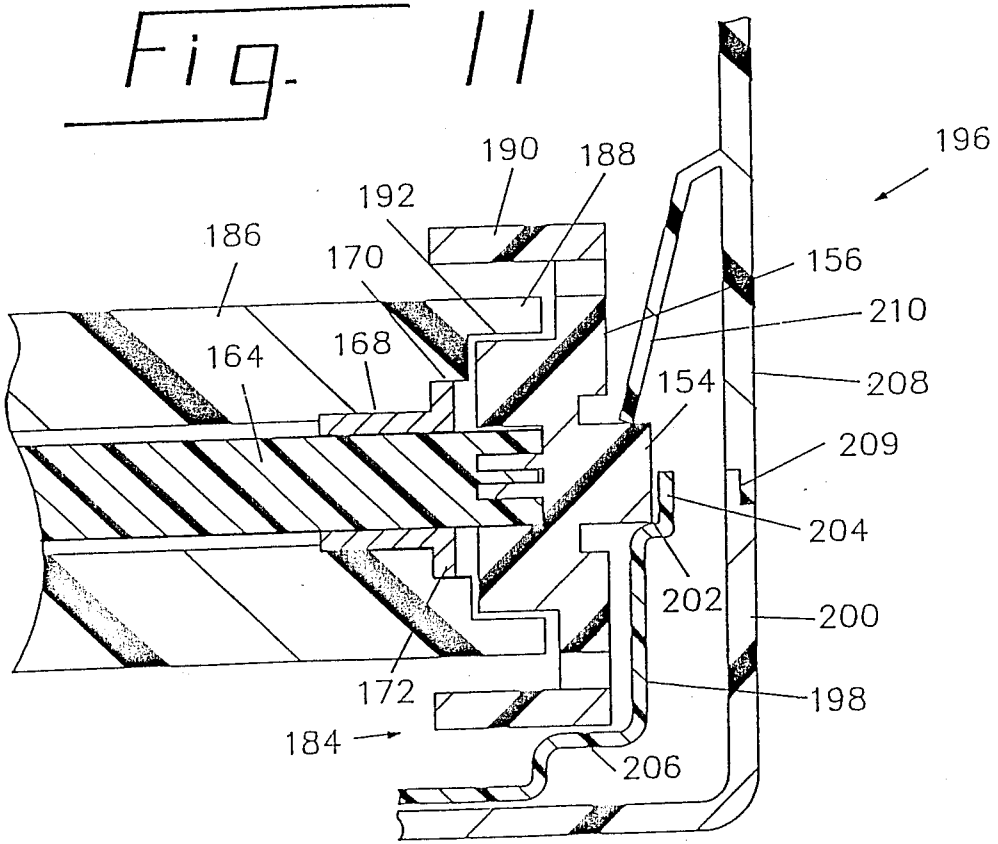
FIG. 11 is a closeup view of the brush spindle and wheel of FIG. 10 installed in a floor tool

Central disk 148 includes a hub 154 protruding toward end 128 (FIG. 11). A ring 156, concentric with hub 154, is disposed at a radius substantially equal to a radius of part-circular back-up rib 144 (FIGS. 6 and 7). At the side opposite to that containing hub 154, central disk 148 includes a guide disk 158 having a blind hole 160 centered therein. A septum 162 spans the diameter of blind hole 160.

In FIG. 8, a guide rod 164 passes loosely through an axial bore 166 in brush spindle 65. First and second counterbores 168 and 170 in each end of brush spindle 65 (only one end is shown) accommodate a bushing 172. An axial bore 174 permits guide rod 164 to pass therethrough and facilitates relative rotation therebetween. An end portion 176 of guide rod 164 is sized for insertion into blind hole 160 with a slot 178 fitting onto septum 162. A flange 180 on bushing 172 is recessed within counterbore 170 to provide an annular guide recess 182 having a diameter to accept guide disk 158 of flex-rim wheel 146 therein when the elements in FIG. 8 are fitted together in their operational positions.

As shown in FIGS. 6–9, to install cylindrical brush 56 in brush housing 52, a flex-rim wheel 146 is placed on each end of guide rod 164. In this condition, an end portion 176 at each end of guide rod 164 is inserted into its respective blind hole 160. The lengths of brush spindle 65 and guide rod 164 are such that this positioning places guide disk 158 of each flex-rim wheel 146 abutting ends of brush spindle 65. In one embodiment, in the described condition, each guide disk 158 guidingly enters its respective annular guide recess 182.

The lengths of brush spindle 65 and guide rod 164 are also effective to position both flex-rim wheels 146 at axial locations wherein ring 156 on each is disposed for abutment with inner surfaces of outwardly angled portion 136 and part-circular back-up rib 144. Hub 154 on each flex-rim wheel 146 extends between legs of hair-pin-shaped hub guide 138. Brush spindle 65 is installed by pressing each flex-rim wheel 146 upward until it locks in place with hub 154 resting against part-circular hub retainer 140 with the axis of hub 154 co-located with center 142. (FIG. 6). An outside diameter of rim 150 is greater than the distance between retainer arms 130 and 132 at their closest approach. Rim 150 is deflected resiliently inward as it moves over-center past the point of closest approach and then expands slightly into stable contact with outwardly angled portions 134 and 136. The small number of spokes 152, and their diagonal orientation, contributes to the required resiliency of rim 150. A sufficient amount of resilient deformation of rim 150 is maintained in the stable position to prevent rotation of flex-rim wheel 146 during operation of power brush attachment 14. Engagement between septum 162 and slot 178 at each end of guide rod 164 retains guide rod 164 in the non-rotating condition. Thus, rotation is constrained to cylindrical brush 56 with a bushing 172 contacting guide rod 164 near each end of cylindrical brush 56.

It was discovered that the construction of FIGS. 6–9 permits objects such as, for example, hair and threads, to become wound about guide rod 164 and interfere with free rotation of brush spindle 65. In normal use, the user must occasionally remove brush spindle 65 and flex-rim wheels 146 from power brush attachment 14 to clear such objects. The present invention prevents objects from becoming wound about guide rod 164, and thus eliminates the problem.

Figure 10:
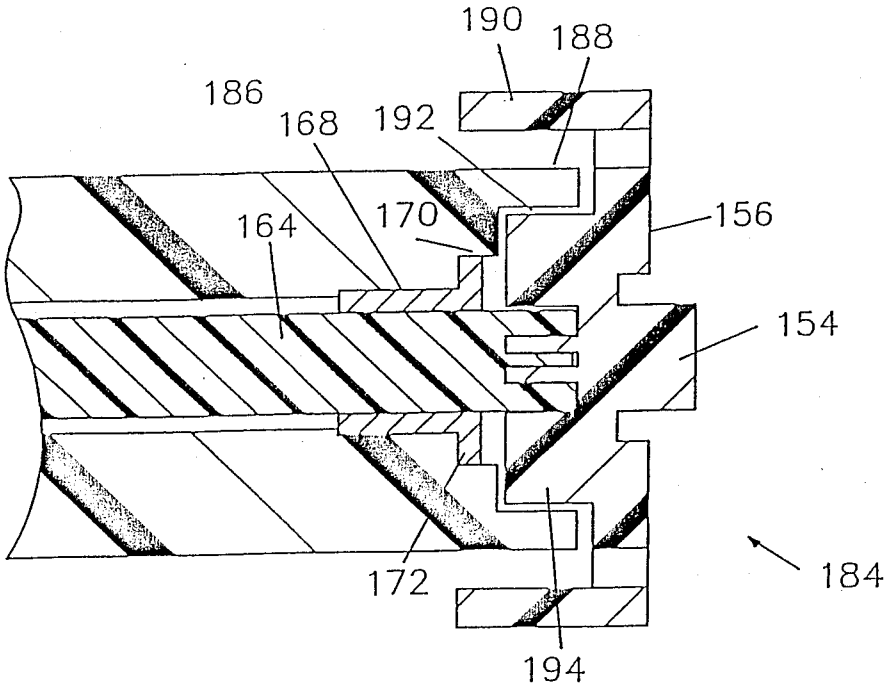
FIG. 10 is a closeup cross section of an end of a brush spindle mated to a wheel according to an embodiment of the invention.

As shown in FIG. 10, a wheel 184 is shown installed on an end of a brush spindle 186. An annular extension 188 on brush spindle 186 extends a substantial distance toward wheel 184. An outer ring 190 extends toward brush spindle 186, overlapping annular extension 188. Annular extension 188 forms an inner cavity 192 in the end of brush spindle 186. A guide disk 194, centered in wheel 184 extends a substantial distance into inner cavity 192. The remaining components in FIG. 10 have functions similar to those in the prior embodiment and thus do not require description.

It will be noted that outer ring 190 overlaps annular extension 188 and that annular extension 188, in turn, overlaps guide disk 194. As a consequence, it is difficult, or impossible, for string, hair, and the like, to enter and become wound upon guide rod 164.

The embodiment in FIGS. 6–9, corresponding to the disclosure of the reference patent, suffers another problem. As shown in FIGS. 6–9, it has been found that, over time, flexible rim 150 and retaining arms 130 and 132 tend to lose their resilience, as is common with substantially all resin materials. This tendency is accelerated by elevated temperatures. When resiliency is lost, flexible rim 150 may not be gripped firmly enough to prevent rotation, or to remain in position holding cylindrical brush 56 in position.

In FIG. 11, there is shown an improved technique for retaining brush spindle 186 in position in a floor tool 196. An inner shroud 198, whose other functions are not of concern to the present disclosure, is disposed within a lower floor tool wall 200. Inner shroud 198 includes at least one support shelf 202 supporting wheel 184 from below. Support shelf 202, as shown, supports a lower perimeter of hub 154. In addition, a vertical member 204 on inner shroud 198 contacts an end of hub 154 to limit the transverse outward position of wheel 184. A second support shelf 206 may be provided for supporting outer ring 190, either in addition to, or in place of, support shelf 202.

An upper floor tool wall 208 mated to lower floor tool wall at a joint 209 includes a resilient locking tab 210 extending at an angle therefrom into locking contact with an upper surface of hub 154.

To install brush spindle 186, a wheel 184 is placed on each end of brush spindle 186. Wheels 184 are urged downward in the figure, whereby hubs 154 bear against the inclined surfaces of their respective resilient locking tabs 210. Resilient locking tabs 210 are thereby deflected outward until the tops of hubs 154 pass. Then, resilient locking tabs 210 snap inward to their locking positions.

It is worth noting that, in its locking position shown, resilient locking tab 210 is in an unstressed condition. As a consequence, the tendency of resin to take a set in a stressed position does not occur. In addition, retention of wheel 184 does not rely on resilient urging from an external or internal member. Thus, reliable, long-term retention is provided by the technique shown and described.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A floor tool for a vacuum cleaner comprising:

a brush mounted for rotation upon a brush spindle;

first and second support wheels;

cooperating means in said first and second support wheels and said brush spindle for supporting said brush spindle;

said first and second support wheels each including a hub extending axially therefrom in a first direction;

said floor tool including a support surface upon which said hub is supported against displacement in a first direction;

said floor tool further including a resilient locking tab affixed at a first end to said floor tool;

a second end of said locking tab being free;

said second end being disposed to contact said hub for locking said hub against motion in a second direction opposite to said first direction and to maintain said hub in contact with said first support surface; and a resilience of said locking tab permitting said second end to be deflected out of locking contact with said hub, whereby said support wheel and said spindle can be installed in and removed from said floor tool.

2. The floor tool according to claim 1, wherein:

said floor tool includes a lower floor tool portion and an upper floor tool portion;

means for mating said lower floor tool portion to said upper floor tool portion;

said support surface disposed in said lower floor tool portion;

said upper floor tool portion including an upper floor tool wall; and said resilient locking tab being affixed to said upper floor tool wall.

3. A floor tool according to claim 2 wherein said locking tab is integrally formed with said upper floor tool wall.

4. A floor tool according to claim 2, wherein:

said locking tab includes an inclined portion between said upper floor tool wall and said end; and said locking tab is deflectable toward said upper floor tool wall for release of said hub.

5. A floor tool according to claim 4, wherein:

said inclined potion is deflected by said hub during insertion of said spindle and said support wheel into a position permitting said hub to pass; and a resilience of said locking tab being effective to permit said end of said locking tab to spring outward into said locking position when said hub has moved therepast into its operational position.

6. A rotatable brush and mounting for a floor tool of a vacuum cleaner, comprising:

a floor tool housing having first and second spaced wall portions, each wall portion having a first support surface and a resilient tab connected at its proximate end to said wall portion and having its distal end extending in the direction of and spaced from said first support surface;

a brush spindle having a plurality of bristle tufts of a first type and of a second type extending outwardly therefrom, said first tufts having a length dimension and a stiffness and said second tufts having a length dimension greater than the length dimensions of said first tufts and a stiffness less than the stiffness of said first tufts, said spindle having an annular longitudinal extension at each end thereof;

a longitudinally extending spindle shaft upon which said brush spindle is mounted for relative rotation, the opposite ends of said spindle shaft extending outwardly of each end of said brush spindle; and a mounting wheel at each end of said brush spindle, each mounting wheel having an outside diameter surface and, on one side thereof, a hub supported on said first mounting surface of said wall portion and held in place thereon by the distal end of said resilient tab, and, on the other side thereof, a central bore for receiving an end of said spindle shaft and an annular groove for receiving said annular extension of said brush spindle in an overlapping relationship.

7. The rotatable brush and mounting for a floor tool of a vacuum cleaner as claimed in claim 6, wherein said first tufts and second tufts comprise, respectively,.a plurality of individual bristles having a first diameter and a plurality of individual bristles having a second diameter, the second diameter less than the first diameter.

8. The rotatable brush and mounting for a floor tool of a vacuum cleaner as claimed in claim 7, wherein each of said tufts has a tuft diameter, the diameter of said first tufts greater than the diameter of said second tufts.

9. The rotatable brush and mounting for a floor tool of a vacuum cleaner as claimed in claim 6, wherein said tufts of said first and second types are mounted in alternate fashion along a helical path about the surface of said spindle.

10. The rotatable brush and mounting for a floor tool of a vacuum cleaner as claimed in claim 6, wherein said first tufts are mounted along a first helical path about the surface of said spindle and said second tufts are mounted along a second helical path about the surface of said spindle.

11. The rotatable brush and mounting for a floor tool of a vacuum cleaner as claimed in claim 6, wherein each end of said spindle shaft has a slot formed therein.

12. The rotatable brush and mounting for a floor tool of a vacuum cleaner as claimed in claim 11, further comprising: a key tab within the bore of said mounting wheel for engagement with said slot in the end of said spindle shaft.

13. The rotatable brush and mounting for a floor tool of a vacuum cleaner as claimed in claim 6, wherein said floor tool housing further comprises: a second support surface for engagement with said outside diameter surface of said mounting wheel.

* * * * *

UNITED STATES PATENT AND TRADEMARK OFFICE

CERTIFICATE OF CORRECTION

PATENT NO. : 4,912,805

DATED : April 3, 1990

INVENTOR(S) : Charles Z. Krasznai, Michael E. Bitzel, Richard B. Kosten
William D. Ryckman

It is certified that error appears in the above-identified patent and that said Letters Patent is hereby corrected as shown below:

ON THE TITLE PAGE

Item [75] Inventors: Richard B. Kosten should be added as a co-inventer.

Signed and Sealed this

Fourth Day of February, 1992

*Attest:*

HARRY F. MANBECK, JR.

*Attesting Officer*

*Commissioner of Patents and Trademarks*